US006945306B2

(12) United States Patent
Duncan et al.

(10) Patent No.: US 6,945,306 B2
(45) Date of Patent: Sep. 20, 2005

(54) CONTROL OF DEPOSITION AND OTHER PROCESSES

(75) Inventors: Stephen Richard Duncan, Bucks (GB); Patrick Spencer Grant, Oxford (GB)

(73) Assignee: Isis Innovation Limited, Summertown (GB)

( * ) Notice: Subject to any disclaimer, the term of this patent is extended or adjusted under 35 U.S.C. 154(b) by 0 days.

(21) Appl. No.: 10/399,796

(22) PCT Filed: Oct. 31, 2001

(86) PCT No.: PCT/GB01/04840

§ 371 (c)(1),
(2), (4) Date: Jul. 30, 2003

(87) PCT Pub. No.: WO02/36845

PCT Pub. Date: May 10, 2002

(65) Prior Publication Data

US 2004/0020624 A1 Feb. 5, 2004

(30) Foreign Application Priority Data

Nov. 3, 2000 (GB) ..... 0026868

(51) Int. Cl.[7] ..... B22D 23/00
(52) U.S. Cl. ..... 164/46; 164/4.1; 164/271
(58) Field of Search ..... 164/46, 4.1, 271

(56) References Cited

U.S. PATENT DOCUMENTS

| | | | | |
|---|---|---|---|---|
| 4,858,556 A | | 8/1989 | Siebert | 118/664 |
| 5,507,870 A | | 4/1996 | Siebert | 118/664 |
| 5,601,649 A | | 2/1997 | Fujino et al. | 118/688 |
| 5,726,919 A | | 3/1998 | Azad et al. | 364/578 |
| 5,731,030 A | | 3/1998 | Friese et al. | 427/8 |
| 5,893,050 A | | 4/1999 | Park et al. | 702/97 |
| 5,926,402 A | | 7/1999 | Tatsuta et al. | 364/578 |
| 6,179,039 B1 | * | 1/2001 | Grinberg et al. | 164/4.1 |
| 6,537,605 B1 | * | 3/2003 | Kirchner et al. | 427/8 |

FOREIGN PATENT DOCUMENTS

| | | | |
|---|---|---|---|
| DE | 197 56 467 | 12/1997 | B05D/1/00 |
| DE | 198 37 400 | 8/1998 | C23C/4/12 |
| EP | 0 290 368 | 5/1988 | C23C/4/12 |
| EP | 0 952 237 | 10/1997 | C23C/4/12 |
| EP | 1 038 987 | 3/2000 | C23C/4/18 |
| GB | 2 340 508 | 12/1998 | C23C/16/44 |
| JP | 09 200 755 | 7/1997 | C23C/1/12 |
| JP | 11 068 884 | 3/1999 | B23K/9/095 |

* cited by examiner

*Primary Examiner*—Tom Dunn
*Assistant Examiner*—I.-H. Lin
(74) *Attorney, Agent, or Firm*—Gordon & Jacobson, PC

(57) ABSTRACT

A system for incrementally depositing material includes a delivery system for directing a material toward a deposition zone (5), a monitoring system for monitoring a parameter of the deposited (a) material and a processing system (11) arranged to obtain a monitored value for the parameter, derive a predicted future parameter value for the monitored parameter, compare the predicted value with a reference parameter value for the monitored parameter, and produce a control output based on the comparison of the predicted value with the reference value, the control output being capable of modifying operation of the system. The parameter monitored has the tendency to vary over time (and space), and the processing means ensure that control output is not based upon the difference between an originally monitored parameter value and a reference value but rather between a prediction generated value (accounting for passage of time or spacital difference) and the reference value. This provides for more accurate process control.

33 Claims, 6 Drawing Sheets

CONTROL OF DEPOSITION AND OTHER PROCESSES

CROSS-REFERENCE TO RELATED APPLICATION

This application is 371 of PCT/GB 01/04840 filed Oct. 31, 2001.

BACKGROUND OF THE INVENTION

1. Field of the Invention

The present invention relates primarily to control for processes involving deposited material (such as for example molten metal spraying processes).

2. State of the Art

WO-A-96/09421 discloses a technique for spraying molten metal (particularly steel) to produce self supporting articles. In the process disclosed it is clear that for a practically realisable process, accurate control of the temperature of the sprayed metal droplets and/or the temperature of the already deposited material is important. Such considerations are also relevant to spraying of other materials and other processes (such as deposition processes). Additionally other parameters for such processes may require monitoring, regulation and control.

SUMMARY OF THE INVENTION

According to a first aspect, the present invention provides a system for incrementally depositing material, which system comprises:

(a) delivery means for directing a material toward a deposition zone;

(b) monitoring means for monitoring a parameter of the deposited material, the monitored parameter being indicative of a condition of the material;

(c) processing means arranged to:

i) receive an input from the monitoring means and obtain a monitored value for the parameter;

ii) derive a predicted future parameter value for the monitored parameter;

iii) compare the predicted value with a reference parameter value for the monitored parameter; and, iv) produce a control output based on the comparison of-the predicted value with the reference value, the control output being capable of modifying operation of the system.

The parameter monitored has the tendency to vary over time, and the processing means ensure that control output is not based upon the difference between an originally monitored parameter value and a reference value but rather between a prediction generated value (accounting for passage of time) and the reference value. This provides for more accurate process control.

Typically the variability in space and time of the parameter monitored will be described by a partial differential equation (typically a parabolic partial differential equation). The technique of the present invention whilst primarily described in relation to temperature regulation for spray deposited metallic material is applicable to other situations and processes where monitored parameters are time variable. Examples of such situations and processes are heat flow, fluid flow, diffusion, decomposition and curing. This list is non-exhaustive.

In a primary embodiment of the invention, the monitored parameter is typically related to the heat characteristic, and is typically the temperature of the targeted zone or spot of the deposit. The temperature will vary over time according to known laws and a predictor model algorithm uses this feature to predict a temperature value at a future instant of spraying at the relevant zone. The difference between the predictor value and reference value dictates the degree of process adjustment required.

The material is typically delivered in flight, preferably as vapour/molten droplets. Typically the material may be delivered by spray delivery means.

The control means preferably operates to modify the temperature of the molten droplets arriving at the surface of the deposit at the deposit zone. This may be achieved by modifying control operators of the delivery means or other system variables such as the separation distance between the spray means and the deposit zone. The control means may therefore operate to adjust the spacing distance between the target surface of the deposit and the delivery means.

The delivery means may be arranged to be operated to produce a scanning or traversing pattern of material deposition or flight delivery over the deposit, in which case the control means beneficially operates to modify the scan or traverse rate or movement direction.

Molten droplets of the material are typically atomised in a conveying gas, the pressure or gas flow rate of the conveying gas beneficially being adjustable in response to output from the control means.

The molten/vapour material may be produced in an electrical heating process stage, the power supply to the electrical heating apparatus being adjustable in response to output from the control means. Additionally or alternatively, the supply rate of material to the heating stage may be adjustable in response to output from the control means. For example in a metallic arc spraying system using one or more wire fed guns, the wire feed rate to the guns may be adjusted by the control means output, typically by adjusting the voltage to the wire feed arrangement.

The above parameter modification features of the system enabled tailoring of the temperature of the deposit and can be combined to produce optimum spraying characteristics.

The system according to the invention is particularly suited to the production of relatively large articles in which localised differences in thermal conditions and/or thermal history can lead to differential thermal contraction and distortion. The accurate feedback control enables the spraying regime for such large articles to be closely and accurately regulated.

The parameter measured by the monitoring means is preferably temperature (or related to temperature). To this end the monitoring means may include one or more temperature responsive devices, such as, for example, thermocouple devices. Beneficially the monitoring means includes a non-contact monitoring device, (preferably sensing electromagnetic radiation) such as an optical pyrometer. In one embodiment an infra-red pyrometer is used to measure the temperature at the surface of the deposit.

The monitoring means is arranged to monitor at one or more points of the deposit. An array of monitoring devices targeting spaced locations may be provided or, additionally or alternatively, a device may target contemporaneously or sequentially a plurality of spaced locations (for example, either by translating/scanning the device over the deposit or by rotating the deposit about an axis spaced from the targeting axis of the monitoring device). Monitoring of the various locations may be sequential or contemporaneous.

The monitoring means may be arranged to provide detailed data relating to the monitored parameter across a relevant region of the deposit.

It is preferred that rather than spot temperature monitoring, the monitoring means is capable of observing or generating a 2-D map or image of the deposited material at the deposition zone.

In a preferred embodiment, thermal imaging apparatus (preferably infra-red thermal imaging apparatus) may be used to give thermal data over a significant surface zone of the deposit.

The control reference parameter value data held by the control means may vary in a predetermined regime in accordance with a demand profile of the control means.

The control reference and control output are related to the monitored parameter by a control algorithm. Control aspects of the system are explained in further detail herein:

In one embodiment according to the invention, molten metal is spray deposited using the electric arc spray process. The molten metal is produced by direct current arcing between two oppositely charged wires made of the metal that is to be sprayed. The arcing causes the wire tips to melt and a high-pressure inert gas stream continuously strips molten material from the arc, atomising it into a spray of droplets. The gas stream carries the droplets to the surface of the object where they are deposited. Wire is continuously fed to the arc gun to maintain the flow of sprayed metal and the amount of metal that is deposited can be adjusted by changing the feed rate of the wire. A reading may be taken of the temperature of the surface of the object being sprayed. The temperature may be measured using a spot pyrometer, but other temperature measurements methods could be used, for example, by taking the average of the temperature at a number of points across the surface as measured by a thermal imaging camera. The measurement of the temperature may be represented as a voltage that is fed into a computer via an analog to digital converter. In the processor, a program carries out a prediction step to predict the temperature value for a spot or array of spots at the object surface at a predetermined future event time. The future event time corresponds to the next time the control system directs the spray gun to direct molten material to impinge upon the relevant spot, the predicted value profile is repeatedly compared with the desired temperature and uses the difference between these two values to adjust the feed rate of wire to the arc spray gun. This is done by generating a voltage via a digital to an analog converter that is applied to the potentiometer in the arc spray controller that regulates the wire feed rate. If the measured temperature is lower than the desired temperature, the feed rate is increased so that the amount of hot metal being sprayed onto the object is increased, causing the temperature of the surface to rise. If the measured temperature is above the desired temperature, the wire feed rate is reduced, reducing the amount of hot metal that is sprayed onto the surface, allowing the surface to cool.

In contrast to prior art spraying systems, where the surface temperature is either not controlled, or controlled manually, the use of the inventive system of feedback control:

(a) regulates the spraying process so the surface of the object is maintained close to its desired value even in the presence of disturbances and/or changes to the process;

(b) rapidly adjusts the wire feed rate so that the surface temperature moves to the required value following a change in the desired temperature;

(c) ensures that the surface temperature follows a changing "temperature trajectory", for example, during the early stages of the spraying process.

The invention is applicable to controlling surface temperature during other spraying processes (e.g. plasma spraying) where adjusting operating parameters such as plasma current, plasma voltage, spray distance, and plasma gas composition changes the temperature of the surface.

The system can be used to spray to a predetermined desired temperature profile at which different surface zones may be maintained at different temperatures at different times during the spraying process.

BRIEF DESCRIPTION OF THE DRAWINGS

The invention will now be further described in exemplary embodiments of the system according to the invention, in which.

DETAILED DESCRIPTION OF THE PREFERRED EMBODIMENTS

Figure 1:
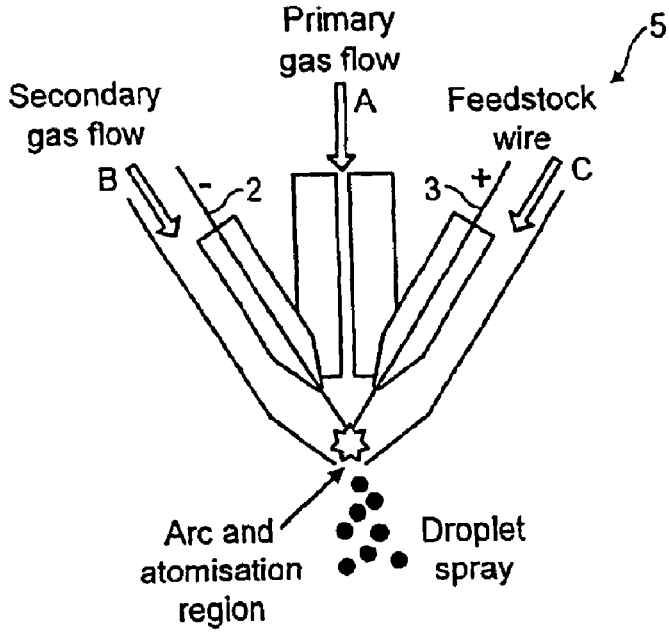
FIG. 1 is a schematic view of an electric arc spray gun apparatus for use in a system according to the invention.
Figure 2:
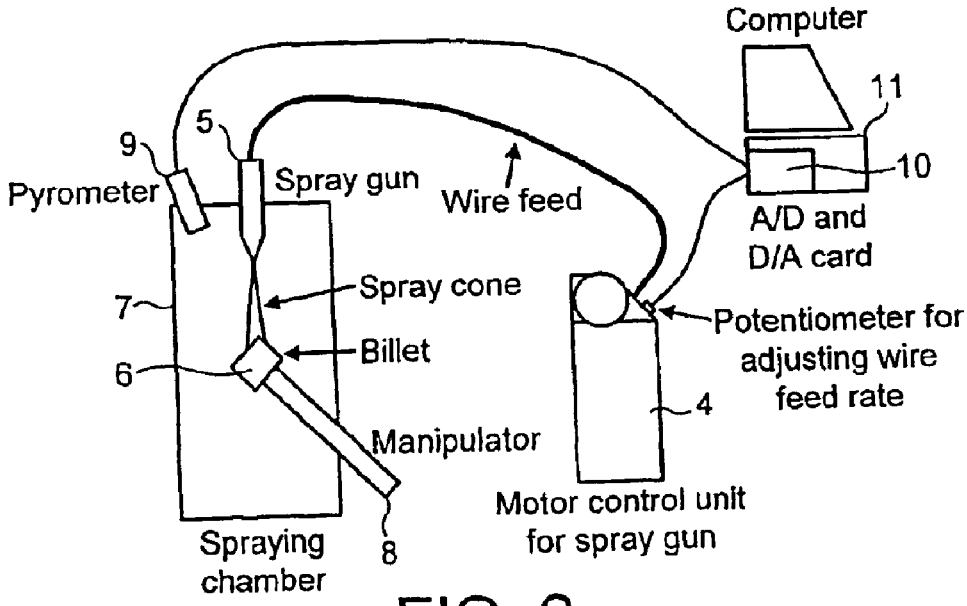
FIG. 2 is an exemplary system according to the invention.

Referring to the drawings and initially to FIGS. 1 and 2, the arc spraying system 1 (see FIGS. 1 and 2) is a Sulzer Metco 4R arc spray system in which a potential difference is applied to two driven wires 2, 3, to form an electric arc between the tips of the wires, as shown in FIG. 1. Various metals can be used in the spray process, but for experimental trials, Fe 0.8 wt % C steel was used. In the nozzle of a spray gun 5, the arc melts the wires and a flow of $N_2$ (arrow A) gas is used to atomise the molten metal and to propel the droplets onto a substrate. The velocity of the steel droplets can be adjusted by varying the pressure of the primary gas flow (arrow A) and the width of the spray cone (i.e. the amount by which the spray diverges from the spray axis). This can be regulated by the pressure of the secondary gas flow (arrows B and C). The wire is fed to the guns by two drive motors, one for each wire, and the wire feed rate can be adjusted by changing the speed of the motors. On the standard 4R system, the speed of the motors is set by adjusting a potentiometer on the wire feed unit 4, which changes the current applied to both motors. Because the temperature of the metal droplets in the spray is greater than the surface temperature of the spray deposited billet 6, the spray acts as a source of heat. Increasing the rate at which wire is fed to the gun results in an increase in the rate at which the hot material is deposited on the surface of the billet leading to an increase in the temperature of the surface. For the 4R gun, the wire feed rate can be varied between 2 and 6 $gs^{-1}$, which for the experimental setup used in this trial, corresponds to surface temperatures in the range 400 to 1000K.

The metal droplets are sprayed onto a steel substrate positioned 170 mm beneath the spray gun 5 in a spraying chamber 7. As the spraying process continues, a spray deposited metal billet 6 (the sprayform) forms on the substrate. The substrate is mounted on a manipulator 8 that maintains the substrate at an angle of 45° to the axis of the spray cone. The manipulator 8 rotates the substrate and billet 6 to ensure even coverage of metal over the surface and also withdraws (retracts) the substrate at a constant rate in order to maintain the top surface of the billet 6 in the same position relative to the spray cone and spray gun 6.

A Land System 4 infrared pyrometer 9 operating at a wavelength of 1.6 $\mu$m measures the temperature of the surface of the sprayform billet 6. This wavelength is selected in order to reduce the effect of dust deposits within the chamber. The pyrometer 9 measures the temperature at a single spot on the surface of the billet sprayform surface 6 and by focussing the pyrometer on a point off the axis of rotation, the spot traces a circle on the surface as the sprayform rotates with the manipulator 8. The pyrometer 9 is focussed on the sprayform at a point that ensures that the reading is not being corrupted by temperature readings from the spray cone.

The output of the pyrometer 9 is a 4 to 20 mA current, which is substantially linear across a temperature range of 300 to 1100K. A 100Ω resistor is placed across the output terminals produced a corresponding voltage range of 0.4 to 2V. As shown in FIG. 2, this voltage is applied to the input of an analogue to digital (A/D) card 10 in a computer 11. A Fairchild PCL-812PG Multi-Lab card is used to interface analogue signals to the PC 11. The card is configured to have an input and output range of 0 to 10V with 12 bit resolution on both A/D and D/A conversions. The temperature of the sprayform billet 6 is sampled by using the A/D to take 20 readings of the voltage generated by the pyrometer 9 at a rate of 50 Hz and averaging these samples to smooth out variations due to droplet splashing etc. This sampling and smoothing operation was repeated every second, giving a sampling frequency for the smoothed readings of 1 Hz.

The voltage of the sampled reading was converted to the corresponding temperature in the computer using an algorithm to predict the temperature value of the sampled spot at the next programmed instant of spraying at the sampled spot. By comparing the predicted temperature value with the desired (referenced) temperature value entered by the user, an adjustment to the wire feed rate was calculated. In its standard (prior art) set-up, the wire feed rate is adjusted manually by changing the setting on a potentiometer that varies the current applied to the motors feeding the two wires. According to this embodiment of the present invention, the potentiometer is by-passed and the motor current varied by applying a voltage, generated by the D/A converter 10 in the computer 11, across the terminals of the potentiometer. A voltage range of 0 to 10 v from the D/A converter 10 changed the wire feed from 0.2 to 6 g/s. The control law that generated the required wire feed rate, together with the user interface, were implemented in Visual C++.

In order to design the controller algorithm for the system, the process is first modelled.

Although the primary function of the spray is to deposit metal on the surface of the sprayform billet 6, the spray also acts as a source of thermal energy. Applying a simple heat balance to the system gives $$cm\frac{d\theta}{dt} = q(t) - hA[\theta(t) - \theta_o] \tag{1}$$

where c is the specific heat capacity of the steel in the sprayform, m is the mass of the sprayform and q(t) is the rate at which thermal energy supplied by the spray, which depends upon the wire feed rate to the spray gun. The second term on the right hand side of (1) describes the heat losses to the surroundings, which will be dominated by the forced convection between the surface of the sprayform at temperature, θ(t), and the temperature of the gas θ. The heat loss due to convection depends upon A, the surface area of the sprayform and h, the coefficient of heat transfer, which in turn, depends upon the properties of the gas, the geometry and orientation of the sprayform and gas flow rate (Lydersen, 1979).

In principle, it would be possible to measure all the parameters in (1) and to implement a "feedforward" controller that uses the model to predict the wire feed rate required to provide the required surface temperature, θ(t). In practice, it is not straightforward to measure some of these parameters, particularly the coefficient of heat transfer by convection and the rate of heat generation by the spray guns. Also other parameters, such as the mass of the sprayform billet 6 and its surface area, will change during the spraying process. An additional problem is that a feedforward controller will not be able to compensate for unknown disturbances that enter the process or for any effects that are not modelled by (1). For this reason, a feedback control system is implemented, where the control law is developed from the model in (1) that uses parameters estimated from experiments. It is accepted that these parameters will not accurately model the response of the system over the full range of opening conditions, but by ensuring that the control law is sufficiently robust, the system will continue to operate satisfactorily even when the parameters of the model are inaccurate and/or when the actual response of the system includes dynamics that are not described by the simple model in (1). In addition, the feedback system will minimise the effects of any disturbances that enter the process.

The rate of heat generation from the gun increases as the wire feed rate increases, assuming that factors such as gas pressure, the distance from the gun to the surface of the sprayform etc., remain constant. For the purposes of the control design, the voltage, v (t), applied to the variable resistor that controls the wire feed rate, can be regarded as the input to the process. If it is assumed that the rate of heat is directly proportional to the wire feed rate, then since the variable resistor is a linear, g(t) can be modelled as $$q(t)=q_o v(t) \tag{2}$$

where $q_o$ is a constant of proportionality. Using this expression in (1) leads to $$\frac{cm}{hA}\frac{d\theta}{dt} + \theta(t) - \theta_o = \frac{q_o}{hA}v(t) \tag{3}$$

It is convenient to express the temperature relative to the temperature of the gas by defining $$\tau\frac{d\tilde{\theta}}{dt}+\tilde{\theta}(t)=gv(t) \tag{4}$$

where $\tau$=cm/hA and $g=q_{ol}$ hA. Although both the mass of the sprayform, m, and its surface area, A, are changing it is assumed that their rate of change is slow compared to the dynamics of the heating process.

Figure 3:
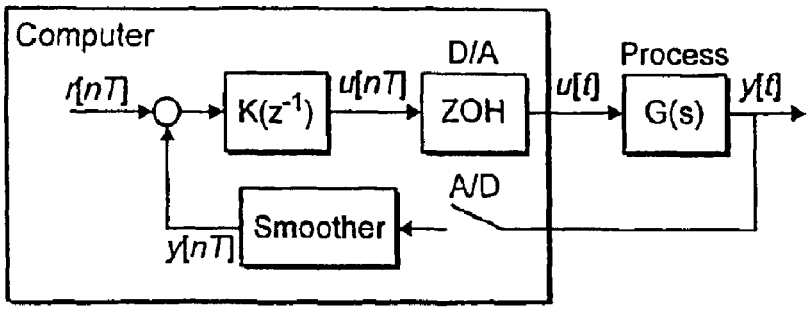
FIG. 3 is a control diagram of the system of FIG. 2.

The system is implemented in "sample and hold" mode, where a smoothed measurement of temperature is taken by the pyrometer 9 at each time step, via the A/D converter 10. The measured temperature is converted to a predicted temperature value (taking into account cooling, heat dissipation and relative movement of the gun and sprayform) based upon the predicted temperature at the monitored point at the next time the spray gun is scheduled to deposit material at the relevant point. The predicted temperature value is compared with the desired (reference) control temperature to generate a new voltage that is applied the variable resistor that adjusts the wire feed rate, at control unit 4, as shown in FIG. 3. This is described in detail hereafter. The voltage is applied through a D/A converter, which acts as a zero order hold (ZOH), so that this voltage remains constant until it is updated at the next time step. If the interval between samples is denoted by T, then the samples will be taken at times t=nT. If a voltage v[nT] is generated by the controller at time t=nT, then the voltage applied by the D/A converter will remain constant over the period $t\epsilon$[nT, (n+1)T). Integrating (4) over this period gives $$\theta[(n+1)T]=e^{-T/\tau}\tilde{\theta}[nT]+g(1-e^{-T/\tau})v[nT] \tag{5}$$

This recurrence relation expresses $\theta$[(n+1)T], the temperature at time t=[(n+1)T], in terms of $\theta$ [nT], the temperature at the previous time step, t=nT, and v[nT], the voltage applied at t=nT.

The two parameters of this relationship, the gain, g, and the time constant, $\tau$, can be estimated by observing the response of the temperature to changes in the voltage applied to the variable resistor. Experimental estimates were:

$$g=16.6VK^{-1} \tag{6}$$

$$\tau=4.3TS^{-1} \tag{7}$$

where $\tau$ is expressed as a multiple of the sample interval, T. These values for the parameters were obtained by determining the values of $e^{-T/\tau}$ and $g(1-e^{-T/\tau})$ that gave the best least squares fit to model in (5) (Ljung, 1987) and then deducing g and $\tau$ from these estimates.

Although there are a number of possible designs that could be used for the computer controller algorithm, a simple integral control law is used. Integral action is used to ensure that there will be no steady state error in the closed response to a step change in the required temperature.

If Z-transforms are applied to the discrete sequences, $\theta$ [nT] and v[nT], then the recurrence relation in (5) can be expressed as $$\theta(z)=G(z)V(z) \tag{8}$$

where $\theta$(z) and V(z) are respectively, the Z-transforms of $\theta$ [nT] and v[nT] and G(z) is the discrete transfer function $$G(z)=g(1-e^{-T/\tau})\frac{z^{-1}}{1-e^{-T/\tau}z^{-1}} \tag{9}$$

with $z^{-1}$ being the delay operator, such that $z^{-1}$v[kT]=v[(k−1)T].

The controller is implemented by comparing the predicted temperature measurements (derived from sampled temperature measurements, $\theta$ [nT]), with the temperature that is required at time t=nT, denoted by r[nT], to form a discrete time error signal $$e[nT]=r[nT]-\tilde{\theta}[nT] \tag{10}$$

At each time step, the voltage, v[nT], is generated from this error signal by the controller. Expressing the signals in terms of the Z-transforms, $$V(z)=K(z)E(z) \tag{11}$$

where K(z) is the discrete transfer function of the controller. A discrete-time integral controller has a transfer function $$K(z)=\frac{k}{1-z^{-1}} \tag{12}$$

where k is the controller gain and the corresponding recurrence relation for the control law is $$v[nT]=v[(n-1)T]+ke[nT] \tag{13}$$

The location of the closed loop poles for this system are given by the roots of the characteristic equation $$z^2=[kg(1-e^{-T/\tau})-(1+e^{-T/\tau})]z+e^{-T/\tau}=0 \tag{14}$$

and by adjusting k, these poles can be positioned so that the closed loop system has a suitable response. A critically damped closed loop response can be achieved by setting $$k=\frac{\tanh(T/4r)}{g} \tag{15}$$

which for the estimated values of g and r results in k=0.0035. This places both closed loop poles z=0.89. A faster closed loop step response can be obtained by increasing the gain to give an underdamped response. If the gain is increased to k=0.0035, the closed loop poles are located at z=0.88±j0.07. For this value of the gain, the settling time following a step change in r[nT] (defined as the number of samples taken to reach 5% of the steady state value) is given by log 0.05/log|p|, where |p| denotes the magnitude of the closed loop poles. When the gain is set to k=0.005, the closed loop system will have s small overshoot, but will settle to within 95% of its final value within 26 samples.

Figure 4A:
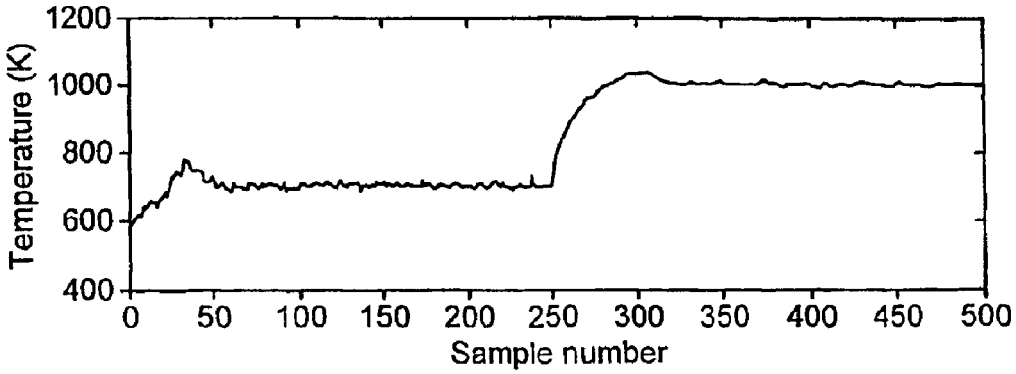
FIG. 4*a* is a plot of the monitored temperature in response to step changes in reference temperature (running under closed loop control) for a first experimental run of the system.
Figure 4B:
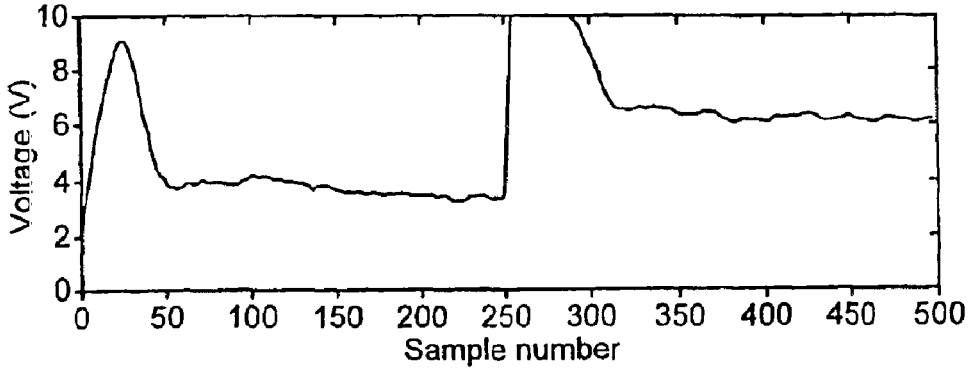
FIG. 4*b* is a plot of the controller output (voltage across load resistor of wire feed drive) to the spray gun apparatus corresponding to the plot of FIG. 4*a;*

Referring now to FIGS. 4*a* and 4*b* in a first experimental run the integral control law was implemented in the form of the recurrence relation in (13) with k=0.005. The voltage generated by the control law was limited to a minimum of 2V to prevent the wire feed stopping and a maximum of 10V, which corresponds to the maximum feed rate that could be achieved by the drive motors. FIGS. 4*a* and 4*b* show the results of applying a series of step changes to the reference temperature, r[nT]. At the start of the experiment, the surface temperature is at 600K and reference temperature is increased to 700K. The control system responds by increasing the wire feed rate by changing the voltage applied to the variable resistor. The temperature settles to the reference value within 50 samples, which is longer than expected from the design. The size of the overshoot is also larger than expected, suggesting that there are errors in the estimated parameters, g and $\tau$ and/or the actual response of the system contains some dynamics not included in the model in (4). Despite these uncertainties, the control system maintains the temperature at the desired value over the period from sample 50 to sample 250. During this period, the control system reduces the wire rate to the spray gun, indicating that less heat is required to maintain the desired temperature. One possible explanation for this is that the chamber itself is heating up and this in turn, raises the temperature of the gas, resulting in a reduction in the thermal losses due to convection. Whatever the reason, the feedback loop maintains the temperature of the sprayform by adjusting the wire feed rate to compensate for the changing conditions. By contrast, if the process was being run in open loop with a fixed wire feed rate then the temperature would drift slowly upwards during this period. During this experimental run, at sample number 250, the reference temperature is increased to 1000K and the control system responds by increasing the wire feed rate. Because of the size of the step change in the required temperature, the voltage demanded by the controller during the transient response is above the maximum allowable voltage, so it is limited to 10V. Despite this constraint, the system settles to the desired temperature, although the effect of the constraint is to increase the length of the transient response. Once settled, the control system continues to adjust the wire feed rate to maintain the temperature at the reference temperature. The variability of the temperature around the desired value is much less when the process is under closed loop control compared to the open loop behaviour: the standard deviation of the temperature under closed loop control is 5.63K, compared to a standard deviation of 9.71K for open loop response.

Figure 5A:
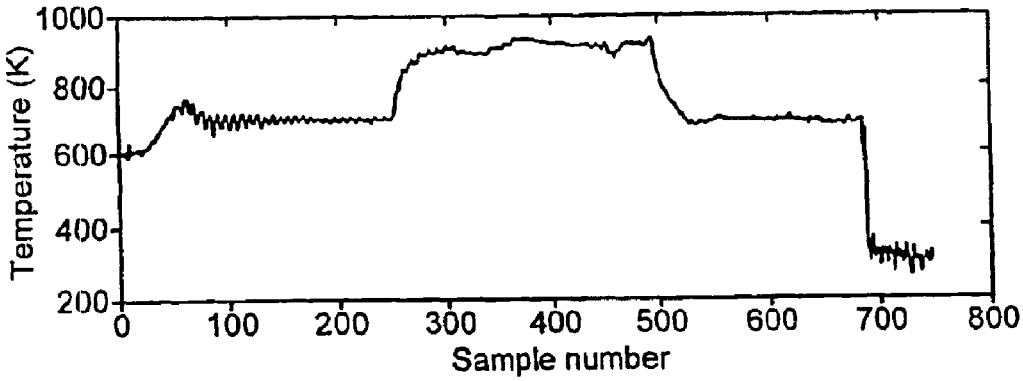
FIG. 5*a* is a plot of the monitored temperature in response to step changes in reference temperature (running under closed loop control) for a second experimental run of the system.
Figure 5B:
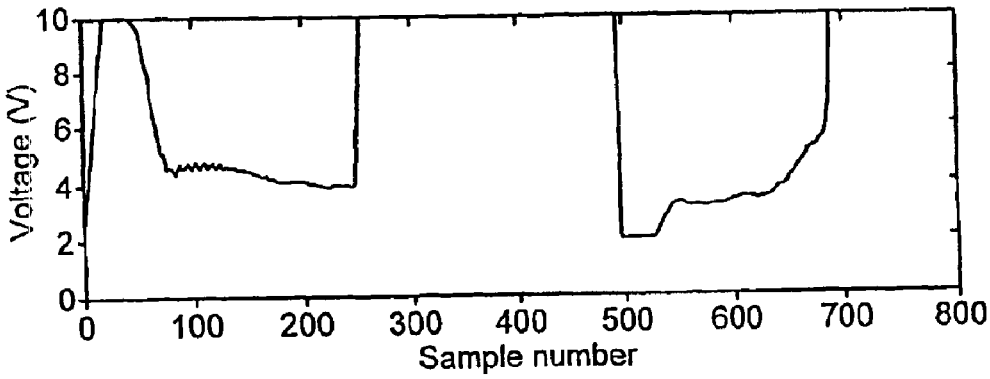
FIG. 5*b* is a plot of the controller output (voltage across load resistor of wire feed drive) to the spray gun apparatus corresponding to the plot of FIG. 5*a;*

FIGS. 5*a* and 5*b* show a second set of results from the closed loop system for a second experimental run of the process. A new billet 6 was put into the chamber and the temperature of the sprayform billet 6 established at 600K. A series of step changes were then applied to the reference temperature, as before. The response of the system in this experiment was considerably different from the response in the previous trial. This is most evident in the period between samples 250 and 490, when the reference temperature is increased to 1000K. Unlike the previous trial, where a temperature of 1000K could be achieved with a voltage setting of around 6.5V, in this experiment, a voltage of 10V, corresponding to the maximum wire feed rate, is insufficient to achieve the desired temperature. Despite the difference in the behaviour of the system, the control system continues to perform well provided that the voltage remains within the allowable range of 2V to 10V. This can be seen in the response to the step change in the reference temperature from 600K to 700 k at the start of the data and the step down to 700K at sample 490. However, it is noticeable that the transient response is significantly worse compared to the responses in FIGS. 4*a* and 4*b*, which is probably due to the difference between the actual open loop response and the open loop response used as the basis of the control design.

The behaviour of the wire feed rate near the end of the run is also interesting. Following the step change at sample 490, the temperature of the sprayform settles to 700K by sample 550. However, in order to maintain the temperature, the control system increases the voltage applied to the variable resistor, giving a corresponding increase in wire feed rate. During the later stages of this run, the gas supply started to run out, resulting in a decrease in gas pressure. This reduced the flow of metal onto the billet 6 surface, with a corresponding reduction in the rate of heating. In order to maintain the temperature at the desired value of 700K, the controller almost doubled the wire feed rate over the period from sample 600 to sample 680 to compensate for the loss of gas flow. Around sample 690, the gas pressure became so low that an automatic cut-out switched off the motors feeding the wire. The fact that control system was able to accommodate a large reduction in the gas pressure indicates that if the feedback system were used to regulate the wire feed rate to a cluster of spray guns, the controller could compensate for the failure of one of the guns by increasing the feed rate to the other guns. This adds a significant degree of robustness to the overall system.

The control system has been based upon an integral control law where the gain is determined from a heat balance model, whose parameters are estimated experimentally. Despite this, the control law is sufficiently robust to operate when these parameters changed and when the response contained dynamics that were not included in the model. The control system was also able to accommodate the limited range of wire feed rates. It is possible that the performance of the system, particularly the time taken to settle following a change in desired temperature, could be improved by using a more sophisticated control law, but the controller must be able to accommodate a high degree of variability within the process.

Figure 6:
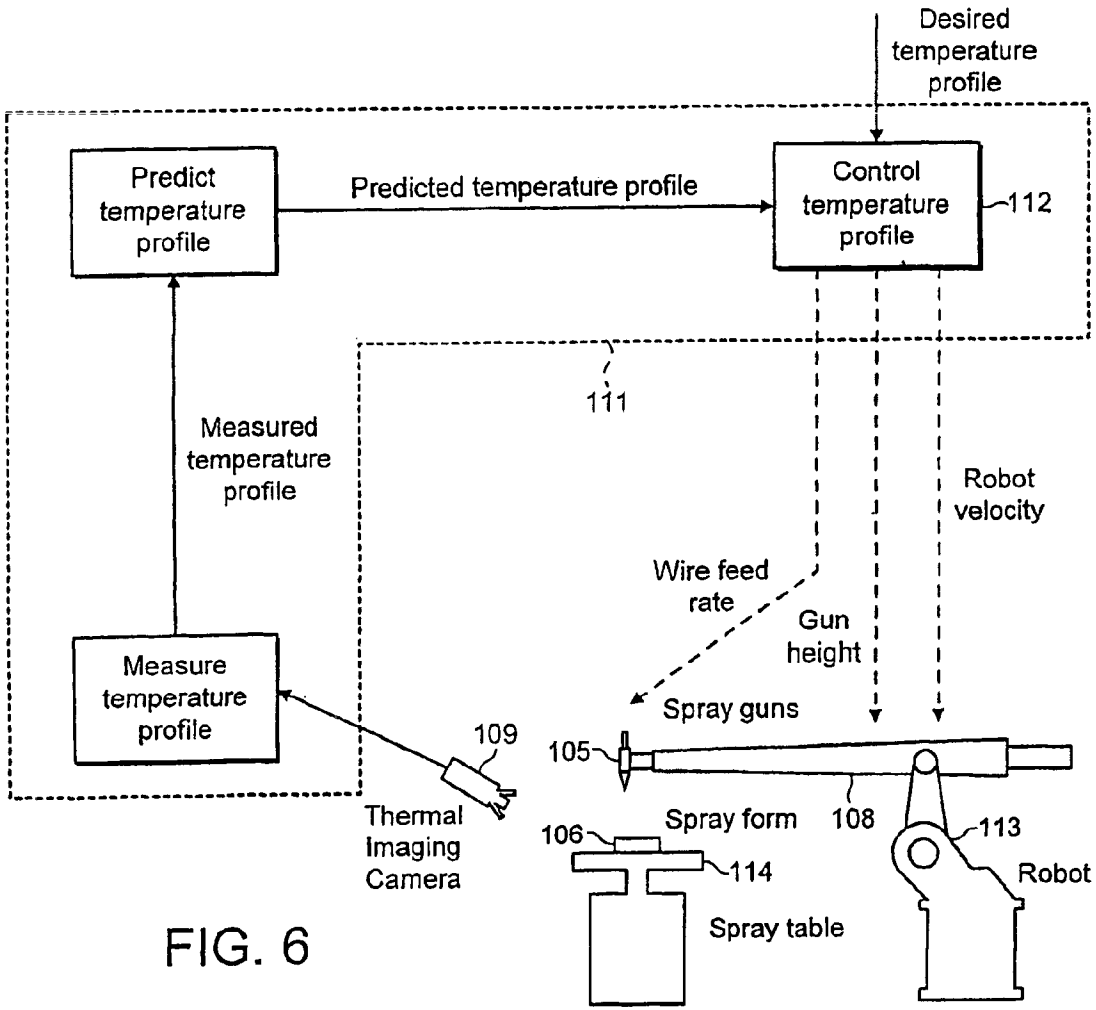
FIG. 6 is a schematic view of an alternative embodiment of system according to the invention.

In the embodiment shown in FIG. 6, an array of spray guns 105 is mounted on a manipulator arm 108 of a positional control robot 113. A processor control unit 111 controls operation of the robot 113 including arm 108 and the wire feed rate supplied to spray gun array 105. Spray guns 105 direct atomised molten metal droplets toward spray table 114 to form a sprayform product 106 which is built up incrementally during spraying. Whereas in the embodiment of FIG. 1, an optical pyrometer (infra-red) was used, the arrangement in FIG. 6 utilises an infra-red thermal imaging camera 109 to obtain thermal data representing the thermal characteristics of sprayform product 106. The thermal data output from image camera 109 is fed to processor and controller 111 where the measured temperature data is used to generate corresponding data representing a predicted temperature profile representative of the estimated temperature profile at a given future instant of time. The predicted temperature profile is compared with a desired (referenced) temperature profile and the control output 112 adjusts one or more system operators accordingly. Such system operators may, for example, be the wire feed rate to spray gun array 105, the spacing of gun array 105 from sprayform product 106, or the scan/sweep movement velocity or path of the gun array 105 (the last two operators being controlled by robot 113 and arm 108).

Figure 7:
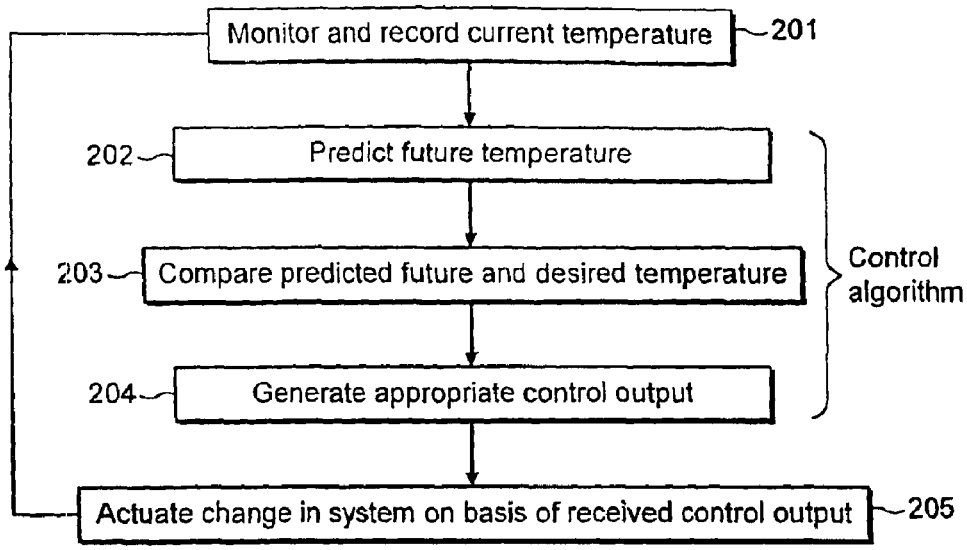
FIG. 7 is a schematic flow diagram of control and processing technique according to the invention.

The processing steps carried out by the microprocessor in processor and controller 111 are identified in FIG. 7. By operating on the monitored and recorded temperature at prediction step 202, the data derived in comparison step 203 can be more accurately relied upon to generate the appropriate control output (step 204) to actuate the change in the relevant system operator (step 205).

Figure 8:
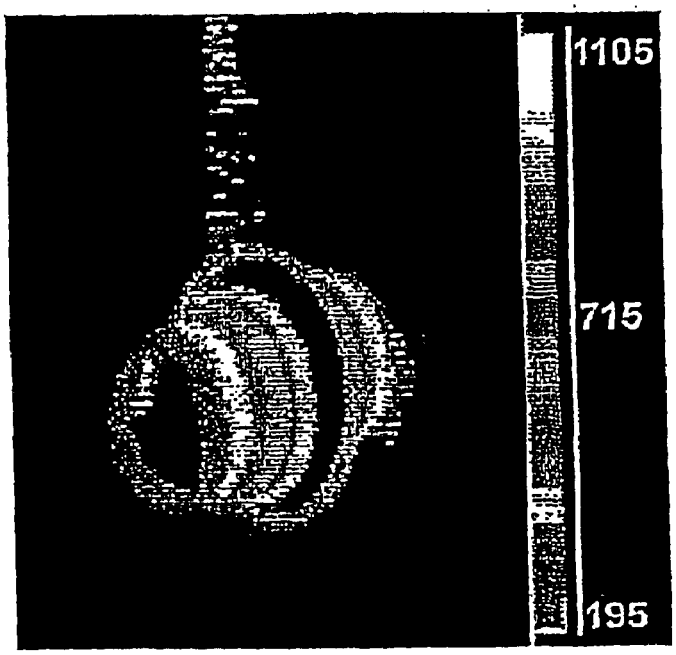
FIG. 8 is a typical view of thermal image data capture used in the system of FIG. 6.

The representative image shown in FIG. 8 shows a detailed overall temperature profile of a sprayformed product 106 which can be generated conveniently using infra-red thermal imaging camera 109, which is particularly suited to application in the technique of the present invention.

The technique has been found to be enhanced where the monitored parameter (temperature) is monitored using a two dimensional (2-D) monitoring system over a large area of the sprayed deposit simultaneously. Such a 2-D system is exemplified by the thermal imaging camera of the embodiment described above. For the controller a thermal model needs to be derived representative of the 2-D situation.

Figure 9:
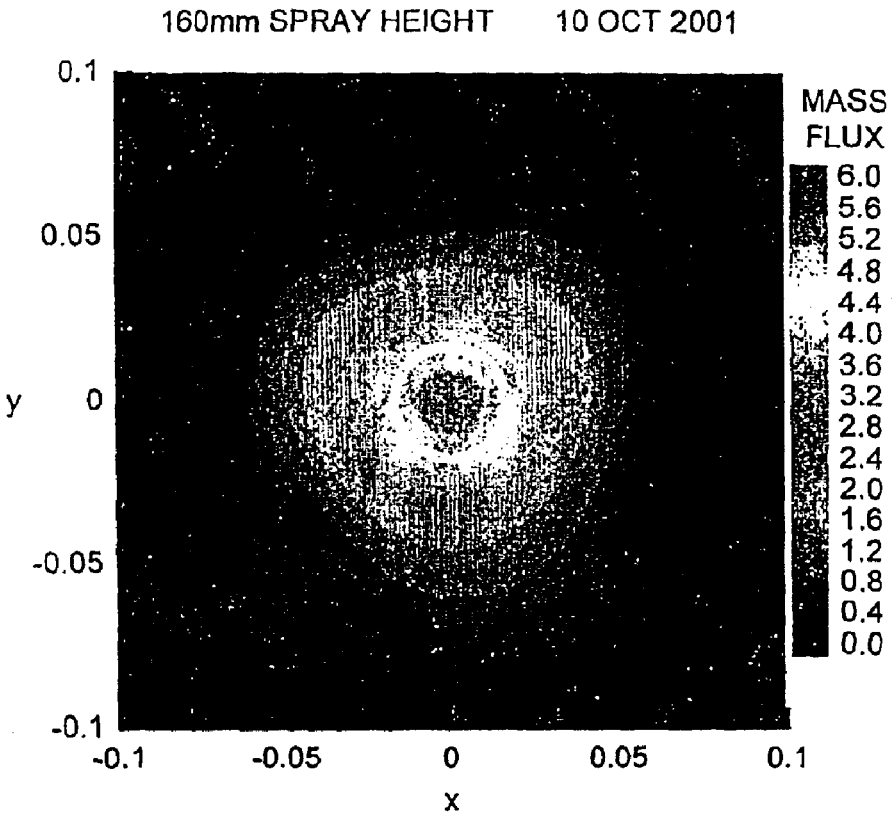
FIG. 9 is a modelled mass flux spatial footprint from a cluster of four spray guns used in a deposition process according to the invention.

The surface of a rectangular sprayed shell is defined as $\{(x,y):0 \leqq x \leqq L_x, 0 \leqq y \leqq L_y\}$. The shell is taken to be flat, but the model can also be used in cases where the surface has topography, provided that the height and the orientation of the robot 113 is adjusted as it scans over the surface to ensure that the spray guns 105 are at a constant distance and angle to the surface. Assuming that the mean wire feed rate remains constant, then the average thickness of the sprayed deposit, z(t), increases uniformly with time, although the model can be readily extended to accommodate a changing average wire feed rate. When the guns are focused on a given position the mass flux profile, m(x,y), generated by a unit wire fee rate is shown in FIG. 9. The shape of this profile is derived from a model of the spray deposition process, where the parameters of the model are determined experimentally in this instance, the sprayforming process uses four guns, where the central gun is positioned normal to the surface at a distance of 160 mm above the sprayed shell and the other three guns are arranged symmetrically around the centre gun at an angle of 45° to the surface. In the control system described here, the wire feed rate is used as the actuation mechanism, other parameters, such as gas pressure, orientation and height of the spray etc, are constant. Under these circumstances, it has been found that the variation of the mass flux "footprint" with wire feed could be considered as linear. On average, the metal droplets in the spray experience almost the same cooling during flight from the gun to the deposition zone surface 105, so the profile of the heat flux, $\bar{f}(x,y)$ generated by the guns for unit wire feed rate, can be taken as proportional to the mass flux in FIG. 9, so that $\bar{f}(x,y)=m(x,y)c(\theta_g-\theta_s)$ where c is the specific heat of the steel, $\theta_g$ is the temperature of the spray as it leaves the guns, $\theta_s$ is the temperature of the surface. In practice, the temperature of the sprayed shell varies over the surface, so $\theta_s$ is not constant. However, the variations in surface temperature are small relative to the difference between the temperature of the spray and the temperature of the surface and as a result, variations in $\theta_s$ are not included in $\bar{f}(x,y)$.

The stream of nitrogen that is used to propel the molten droplets to the surface of the sprayed shell, also provides a significant cooling effect because of the difference between the temperature of the gas and the temperature of the surface. The cooling profile of the nitrogen stream is $\bar{g}(x,y)=H_n(x,y)\ (\theta_n-\theta_s)$ where $\theta_n$ is the temperature of the nitrogen stream and $H_n(x,y)$ is the heat transfer co-efficient. Since the nitrogen is at a lower temperature compared to the surface, $\bar{g}(x,y)$ is generally negative. As with the mass flux profile, the temperature of the sprayed shell will not be constant over the surface, but the variations are small relative to the difference between $\theta_n$ and $\theta_s$ and will be ignored. There is also a noticeable angular variation within the cooling profile due to the arrangement of the gun cluster, but the effect of this variation is smoothed out by rotating the gun cluster 105 as the robot moves over the surface 106.

The time dependence in the thermal footprint comes from the movement of the gun cluster 105 over the surface, so that $f(x,y,t)=\bar{f}(x-v_x t, y-v_y t)$ where $v_x$ and $v_y$ are respectively, the robot velocity in the x and y directions and $\bar{f}(x',y')$ is derived from the mass flux footprint given in FIG. 1, where it is assumed that the shape of the footprint is independent of the position of the gun over the surface. In a similar manner, the cooling due to the nitrogen stream moves with the guns, so that $g(x,y,t)=\bar{g}(x-v_x t, y-v_y t)$. In both cases, the angular dependence of the profiles is removed by averaging the footprints over the rotations applied to the gun cluster during spraying.

If θ(x,y,t) denotes the temperature of the surface at the point (x,y) where the temperature is measured relative to the temperature of the air flow through the spray booth, then the heat balance for an element of area δxδy and thickness z(t) positioned at (x,y) is $$\rho c z(t)\frac{\partial\theta(x,y,t)}{\partial t}\delta x\delta y = Kz(t)\left[\frac{\partial^2\theta(x,y,t)}{\partial x^2}+\frac{\partial^2\theta(x,y,t)}{\partial y^2}\right]\delta x\delta y - H_a\theta(x,y,t)\delta x\delta y + f(x,y,t)u(t)\delta x\delta y + g(x,y,t)\delta x\delta y \tag{1}$$

where ρ and K are, respectively, the density and thermal conductivity of the sprayed steel, $H_a$ is heat transfer coefficient between the surface of the shell and the air stream, u(t) is the wire feed rate. This model assumes that any local variations in the thickness relative to the mean thickness, z(t), and in the conductivity, K, are second order effects that can be ignored. It also takes the heat loss across the interface between the sprayed shell and the ceramic as small and assumes that the through thickness temperature profile remains constant. If any of these assumptions do not hold, then the model can be extended to incorporate these effects.

Dividing (1) through by ρpcz(t)δxδy leads to $$\frac{\partial\theta}{\partial t}=\kappa\left[\frac{\partial^2\theta}{\partial x^2}+\frac{\partial^2\theta}{\partial y^2}\right]-H(t)\theta+\tilde{f}(x,y,t)u(t)+\tilde{g}(x,y,t) \tag{2}$$

where κ=K/ρ c is the thermal diffusivity of sprayed steel and $$H(t)=\frac{H_a}{\rho c z(t)} \tag{3}$$

$$\tilde{f}(x,y,t)=\frac{f(x,y,t)}{\rho c z(t)} \tag{4}$$

$$\tilde{g}(x,y,t)=\frac{f(x,y,t)}{\rho c z(t)} \tag{5}$$

$$\tag{6}$$

The heat transfer coefficient, $H_a$, is derived from the relationship for the Nusselt number, Nu, associated with forced convection from a flat surface (assuming laminar flow, which is reasonable for an air flow velocity of 4 $ms^{-1}$) [2]$Nu=0.664Re^{1/2}Pr^{1/3}$, where Re is the Reynolds number associated with the flow and Pr is the Prandtl number for air. Strictly, the heat transfer coefficient will vary with distance from the leading edge of the flow over the surface, but as the heat loss is dominated by the cooling from the nitrogen stream rather than the air flow, the spatial dependence of $H_a$ will be ignored.

The expression for the last three terms on the right hand side of (2) contain the z(t) term in the denominator. As a result, at the start of the spraying process when z(t) is small, these terms become large and the model will be very sensitive to errors in the parameters. However, when depositing the initial layers of metal, it is more important to ensure good adhesion between the sprayed metal and the ceramic substrate, so the system for regulating the thermal profile is only switched on once a sufficient thickness of metal (typically 1 mm) has been established. The z(t) term in the denominator of the expression for $\tilde{f}(x,y,t)$ also indicates that the "gain" of the heating effect of the gun reduces as the thickness of the sprayed shell increases. However, this is offset by a corresponding reduction in the cooling effect of the nitrogen stream, because of the z(t) term in the denominator in the expression for $\tilde{g}(x,y,t)$.

The boundary conditions for the model represent the heat loss to the flow of air and nitrogen across the edges of the sheet.

$$K\frac{\partial\theta}{\partial x}\bigg|_{x=0} - H_x\theta(0, y, t) = 0 \qquad K\frac{\partial\theta}{\partial x}\bigg|_{x=L_x} + H_x\theta(L_x, y, t) = 0 \tag{7}$$

$$K\frac{\partial\theta}{\partial y}\bigg|_{y=0} - H_y\theta(x, y, t) = 0 \qquad K\frac{\partial\theta}{\partial y}\bigg|_{y=L_y} + H_y\theta(x, L_y, t) = 0 \tag{8}$$

where $H_x$ and $H_y$ represent the heat transfer coefficients across the edges in the x and y directions, together with the final value condition for the temperature in the absence of any forcing terms, $\theta(x,y,t)\rightarrow 0$ as $t\rightarrow\infty$.

This system has a separable solution of the form $$\theta(x, y, t) = \sum_{m=0}^{\infty}\sum_{n=0}^{\infty} q_{m,n}(t)\phi_{m,n}(x, y) \tag{9}$$

where $\phi_{m,n}$ (x,y) are the spatial eigenmodes given by [3]

$$\phi_{m,n}(x, y) = \left(\cos\beta_m x + \frac{H_x}{K\beta_m}\sin\beta_m x\right)\left(\cos\gamma_n y + \frac{H_y}{K\gamma_n}\sin\gamma_n y\right) \tag{10}$$

where $\beta_m$ are the solutions to $$\left(\beta^2 - \frac{H_x^2}{H^2}\right)\tan\beta L_x = \frac{2H_x}{K}\beta \tag{11}$$

and $\gamma_n$ are the solutions to $$\left(\gamma^2 - \frac{H_y^2}{K^2}\right)\tan\gamma L_y = \frac{2H_y}{K}\gamma \tag{12}$$

The eigenvalues associated with each mode are $-\lambda_{m,n}$ where $$\lambda_{m,n}=\beta_m^2+\gamma_n^2 \tag{13}$$

The magnitude of each eigenmode, $q_{m,n}(t)$, satisfies the one-dimensional ordinary differential equation $$\dot{q}_{m,n}(t)=[-\kappa\lambda_{m,n}-H(t)]q_{m,n}(t)+b_{m,n}(t)u(t)+d_{m,n}(t) \tag{14}$$

where $$b_{m,n}(t) = \frac{\int_0^{L_y}\int_0^{L_x}\phi_{m,n}(x, y)\tilde{f}(x, y, t)dxdy}{\int_0^{L_y}\int_0^{L_x}[\phi_{m,n}(x, y)]^2 dxdy} \tag{15}$$

$$d_{m,n}(t) = \frac{\int_0^{L_y}\int_0^{L_x}\phi_{m,n}(x, y)\tilde{g}(x, y, t)dxdy}{\int_0^{L_y}\int_0^{L_x}[\phi_{m,n}(x, y)]^2 dxdy} \tag{16}$$

If M and N denote the controllable bandwidth of actuator then M and N are the smallest values for which $|(b_{m,n}(t)|=0$ for m>M and n>N. Since the cooling profile, $\bar{g}(x,y)$ is wider than the mass footprint in FIG. 9, so the spatial bandwidth of the cooling profile will be less than the spatial bandwidth of the heating profile. As a result, $|d_{m,n}(t)=0$ for m>M and n>N and the cooling footprint will not affect any higher order modes above the controllable bandwidth.

Restricting the model to the M×N controllable modes, then (14) can be represented by a finite dimensional state space model $$\dot{q}(t)=A^c(t)q(t)+b^c(t)u(t)+d^c(t)+\Xi w_1(t) \tag{17}$$

where $A^c(t)$ is a diagonal matrix with diagonal elements $-\kappa\lambda_{m,n}-H(t)$, $b^c(t)$ is a vector containing the $b_{m,n}(t)$terms and $d^c(t)$ is a vector containing the $d_{m,n}(t)$ terms $w_1(t)$ represents the zero mean, unit variance, state noise. A major source of state noise will be the deviations of modelled $d^c(t)$ from the actual cooling profile of the nitrogen streams. The time dependence of A(t) comes from the dependence of H(t), the coefficient of heat lost to the air flow from the surface, which depends upon the mean thickness, z(t) Since z(t) is changing over a number of scans, which slow relative to the changes in $b^c(t)$ and $d^c(t)$ that are changing within a scan, so A is taken as constant. The slow changes in A can be accommodated in the control design by gain scheduling.

The temperature of the surface is measured at each pixel in the thermal image, such that for the pixel positioned at the point, $(x_i,y_j)$, the temperature is $$\theta(x_i, y_j, t) = \sum_{m=0}^{\infty}\sum_{n=0}^{\infty} q_{m,n}(t)\phi_{m,n}(x_i, y_j) \tag{18}$$

If the measurements are stacked into a vector $y^P(t)$, where P is the number of pixels in the array, then the measurement equation associated with the lower order spatial modes, can be expressed as $$y^P(t)=Cq(t)+\Psi w_2(t) \tag{19}$$

where the row of the measurement matrix, C, associated with the pixel at $(x_i,y_j)$ contains terms $\phi_{m,n}(x_i, y_j)$ and $w_2(t)$ represents the zero mean, unit variance, measurement noise. The contribution of the unmodelled, higher order modes to the temperature measurements can be incorporated into $w_2(t)$.

In practice, the control system is operated in sample and hold mode, where the temperature profile is sampled at times, t=kT, and the profile used to generate a wire feed rate, u(kT), that is held constant over the period, $t\epsilon[kT,(k+1)T)$, leading to the discrete time model $$q[(k+1)T]=Aq(kT)+b(kT)u(kT)+d(kT)+\Xi w_1(kT) \tag{20}$$

$$y^P(kT)=Cq(kT)+\Psi w_2(kT) \tag{21}$$

where $A=e^{A^c T}$ and $$b(kT) = \int_0^T e^{A^c(T-t')}b^c(kT+t')dt'$$
$$d(kT) = \int_0^T e^{A^c(T-t')}d^c(kT+t')dt' \tag{22}$$

The model also includes state noise, $w_1(kT)$ and measurement noise $w_2$ (kT) It is these two equations that given the state q(kT) at the time sample taken at t=kT, provide a prediction of the state and the measurements, $y^P(kT)$ at all future time steps.

For a sprayed shell of dimension 300 mm by 300 mm and thickness 5 mm, the time constant of the fastest controllable mode is of the order of 60 s. However, the robot typically moves at 0.2 $ms^{-1}$, so it will move from one side of the shell to the other in 1.5 s. This means that the choice of sample interval, T, is determined not by the inherent dynamics of the system, but instead, by the rate of change of the $b^c(t)$ and $d^c(t)$ terms. For this reason, a sample interval of 0.1 s is used in the implementation.

The aim of the controller is to maintain the controllable states, $q_{m,n}(kT)$ for $m \leqq M$ and $n \leqq N$, as close as possible to some the given desired states, r(kT). Since r(kT) remains constant or changes infrequently, the control design can be regarded as a regulation problem. With only a single actuator, it is not possible to make all M N controllable states match r(kT) exactly, but instead, the best that can be done is to minimise some measure of r(kT)−q(kT). Since the spatial modes are orthogonal, then by Parseval's identity, $\|r(kT)-q(kT)\|_2$ is the variance of the controllable spatial modes of the temperature variation. As a result, the signal $$[r(t)-q(t)]^T W_1^T W_1 [r(t)-q(t)] \tag{23}$$

(where $W_1$ is a weighting matrix) is the weighted variance of controllable temperature variations over the surface, which must be minimised (in some sense) by the controller.

For linear quadratic gaussian (LQG) control, the controller is the combination of a state estimator, in the form of a Kalman filter, which generates a state estimate $\hat{q}(kT)$ and a state feedback gain, such that $$u(kT)=K(kT)[r(kT)-\hat{q}(kT)] \tag{24}$$

where K(kT) is the time varying state feedback matrix. If measurements are available at all pixels, then the state estimates $$\hat{q}(kT|kT)=\hat{q}(kT|(k-1)T]+L(y(kT)-C\hat{q}[kT](k-1)T]) \tag{25}$$

$$\hat{q}[(k+1)T|kT]=A\hat{q}(kT|kT)+b(kT)u(kT)+d(kT) \tag{26}$$

The invention has been primarily described in relation to deposition processes in general and metal spray deposition processes in particular. It will however be appreciated that the invention has application in other techniques or processes.

What is claimed is:

1. A system for incrementally depositing material, which system comprises:

(a) delivery means for directing a material toward a deposition zone;

(b) monitoring means for monitoring a parameter of the deposited material at the deposition zone, the monitored parameter being indicative of a condition of the material; and (c) processing means arranged to, i) receive an input from the monitoring means and obtain a monitored value for the parameter;

ii) derive a predicted future parameter value for the monitored parameter;

iii) compare the predicted value with a reference parameter value for the monitored parameter; and, iv) produce a control output based on the comparison of the predicted value with the reference value, the control output being capable operation of the system.

2. A system according to claim 1, wherein the monitored parameter is indicative of a heat condition of the deposited material.

3. A system according to claim 2, wherein the monitored parameter is indicative of temperature.

4. A system according to claim 1, wherein the monitored parameter is derived from a plurality of temperature measurements of the deposited material made over time.

5. A system according to claim 1, wherein the monitored parameter is indicative of distortion or deflection of the deposit.

6. A system according to claim 1, wherein the delivery means comprises delivery means arranged to direct material in molten or vapor form toward the deposition zone.

7. A system according to claim 1, wherein the delivery means comprises spray delivery means for directing material in the form of a spray toward the deposition zone.

8. A system according to claim 1, wherein the monitored parameter is susceptible to temporal variation, the processing means operating to derive the predicted parameter value taking into account such temporal variation.

9. A system according to claim 1, wherein the control output from the processing means operates to modify the operation of the delivery means.

10. A system according to claim 1, wherein the control output operates to modify the temperature of the deposited material arriving at a surface of the deposit.

11. A system according to claim 1, wherein the control output operates to adjust a spacing distance between a target surface of the deposition zone and the delivery means.

12. A system according to claim 1, wherein the delivery means is arranged to be operated to produce a scanning or traversing delivery pass over the deposition zone.

13. A system according to claim 12, wherein the control output operates to modify the scan or traverse rate.

14. A system according to claim 1, wherein the material exiting the delivery means comprise molten droplets atomized in a conveying gas, the pressure or gas flow rate of the conveying gas being adjustable in response to the control output.

15. A system according to claim 1, wherein the delivery means comprises an electrical heating process stage for producing molten material to be deposited, the power supply of the electrical heating apparatus being adjustable in response to the control output.

16. A system according to claim 1, wherein the material is rendered in molten or vapor form in a heating stage, and the supply rate of material to the heating stage is adjustable in response to the control output.

17. A system according to claim 1, wherein the monitored parameter measured by the monitoring means as temperature or related to temperature.

18. A system according to claim 17, wherein the monitoring means includes one or more temperature monitoring devices.

19. A system according to claim 18, wherein the monitoring means includes one or more pyrometer devices.

20. A system according to claim 1, wherein the monitoring means includes a non-contact monitoring device.

21. A system according to claim 1, wherein the monitoring means is arranged to monitor at one or more points of the deposition material.

22. A system according to claim 1, wherein the monitoring means is arranged to monitor contemporaneous points over an extensive region of the deposition material.

23. A system according to claim 1, wherein the monitoring means is arranged to provide data for the monitored parameter over a relevant region of the deposit, the relevant region including spaced zones or points.

24. A system according to claim 1, wherein the monitoring means comprises data capture mean for capturing monitored parameter data over an extensive region of the deposited material.

25. A system according to claim 24, wherein the data capture means comprises imaging means.

26. A system according to claim 25, wherein the monitored parameter is temperature, the imaging means comprising thermal imaging means.

27. A system according to claim 26, wherein the thermal imaging means comprises infrared thermal imaging means.

28. A system according to claim 1, wherein the reference parameter value varies in a predetermined regime in accordance with a demand profile of the system.

29. A system according to claim 1, wherein the processing means operates a control algorithm to:

A) derive the predicted parameter value for the monitored parameter;

B) compare the predicted value with the reference parameter value for the monitored parameter; and, C) produce the control output based on the comparison of the predicted value with the reference value.

30. A control system for controlling deposition apparatus operating to incrementally deposit material, the control system including monitoring means for monitoring a parameter of the deposited material, the monitored parameter being indicative of a condition of the material and processing means arranged to:

a) receive an input from the monitoring means and obtain a monitored value for the parameter;

b) derive a future predicted parameter value for the monitored parameter;

c) compare the predicted value with a reference parameter value for the monitored parameter; and, d) produce a control output based on the comparison of the predicted value with the reference value, the control output being capable of modifying operation of the system.

31. A method of depositing material, the method comprising:

a) directing material toward a deposition zone;

b) monitoring a parameter the deposited material indicative of a condition of the deposited material;

c) obtaining a monitored value for the parameter;

d) deriving a future predict parameter value for the monitored parameter;

e) comparing the predicted value with a reference parameter value for the monitored parameter; and, f) producing a control output based on the comparison of the predicted value with the reference value, and directing the control output in accordance with the comparison, if required, to modify operation of the system so as to initiate convergence of the monitored parameter value and the reference parameter value.

32. A system for flight delivery of material to an impact zone, which system comprises:

(a) delivery means for directing material in flight toward the impact zone;

(b) monitoring means for monitoring a parameter of material at the impact zone, the monitored parameter being indicative of a condition of the material;

(c) processing means arranged to:

i) receive an input from the monitoring means and obtain a monitored value for the parameter;

ii) derive a future predicted parameter value for the monitored parameter;

iii) compare the future predicted value with a reference parameter value for the monitored parameter; and, iv) produce a control output based on the comparison of the predicted value with the reference value, the control output being capable of modifying operation of the system.

33. A process control method, the method comprising:

a) monitoring a parameter process material;

b) deriving a future predict parameter value for the monitored parameter;

c) comparing the predicted value with a reference parameter value for the monitored parameter; and, d) producing a control output based on the comparison of the predicted value with the reference value, the control output being capable of modifying operation of the system.

* * * * *

UNITED STATES PATENT AND TRADEMARK OFFICE

CERTIFICATE OF CORRECTION

PATENT NO. : 6,945,306 B2 
DATED : September 20, 2005
INVENTOR(S) : Stephen Richard Duncan and Patrick Spencer Grant It is certified that error appears in the above-identified patent and that said Letters Patent is hereby corrected as shown below:

Column 15,
Line 62, "capable operation" should be replaced with -- capable of modifying operation --.

Column 18,
Line 31, "parameter process" shoud be replaced with -- parameter of process --.

Signed and Sealed this

Fourteenth Day of March, 2006

JON W. DUDAS
*Director of the United States Patent and Trademark Office*